United States Patent [19]

Foltyn et al.

[11] 4,319,611

[45] Mar. 16, 1982

[54] PICKING COMB FOR JET LOOMS

[75] Inventors: Jan Foltyn, Brno; Vladimir Kuda, Blazovice; Vladimir Vasicek, Moravsky Krumlov; Jaroslav Koci, Brno, all of Czechoslovakia

[73] Assignee: Vyzkumny a vyvojovy ustav Zavodu, Brno, Czechoslovakia

[21] Appl. No.: 135,115

[22] Filed: Mar. 28, 1980

[30] Foreign Application Priority Data

Mar. 28, 1979 [CS] Czechoslovakia ..... 2046-79

[51] Int. Cl.[3] ..... D03D 47/30

[52] U.S. Cl. ..... 139/435; 139/370.2

[58] Field of Search ..... 139/435, 188, 370.2, 139/370.1; 226/95, 97

[56] References Cited

U.S. PATENT DOCUMENTS 3,565,122 2/1971 Jansa ..... 139/435

4,117,870 10/1978 Gotoh ..... 139/435

4,190,067 2/1980 Kuda et al. ..... 139/435

*Primary Examiner*—Henry Jaudon

[57] ABSTRACT

A picking comb, particularly for jet looms. The comb has an array of active, monitoring and passive guide teeth each having a picking portion and a mounting portion and fixed by its mounting portion in spaced side-by-side releation on a carrier means. At least one of said guide teeth has its picking portion separate from its mounting portion. The picking portion is provided with a connecting element fitting into a corresponding bore in the mounting portion. Correct positioning of the two portions is assured by interfitting positioning parts and a clamping element. The detachable connection between the picking portion and the mounting portion of a tooth makes it easier to replace a defective picking portion without the necessity of removing the whole picking channel or a section thereof.

4 Claims, 5 Drawing Figures

PICKING COMB FOR JET LOOMS

BACKGROUND OF THE INVENTION

The invention relates to an improved arrangement of a picking comb used particularly in jet looms.

Jet looms operate in such a manner that a weft thread of warp width is picked through open sheds along a path formed by the picking comb within which the weft thread is propelled under the action of a pressure fluid such as pressure air or gas expanding from a main nozzle and/or active guide teeth. Within the warp width the picking of the weft thread is monitored by monitoring guide teeth of the picking comb. In fact, the picking comb is formed, on the one hand, of passive guide teeth and, further, of active and detecting guide teeth which are arranged in side-by-side relation so that, by being interconnected and, for example, attached to a sley, they constitute a compact assembly.

The known arrangements of picking combs are made in such a way that the guide teeth are arranged into sections of various lengths, at least in portions the sum of which gives the total warp width. These sections of the picking comb are arranged in several variations.

One of the known constructions of picking combs for jet looms uses common connecting mandrels onto which the guide teeth are fitted, the teeth being axially spaced by means of spacer plates and mutually tightened by connecting means so as to form an assembly or sections fastened to the sley.

In other known embodiments the guide teeth are arranged in a guiding groove of a bar, in which they are relatively fixed in an axial direction by means of pins which fit into respective holes provided on the face of the adjacent guide tooth, the guide teeth being fixed in the guiding groove, for example in a clamping manner, by means of screws and nuts.

In another known embodiment the picking comb is formed of guide teeth sections which are assembled for example of a combination of passive and active guide teeth, the next section being formed of passive and detecting guide teeth, and the other forming self-contained sections having a reduced number of, for example, passive, active and detecting guide teeth. The said sections are formed in such a way that the shanks of the guide teeth are mounted, for example, in a channel or groove of a bar on which they are arranged in a side-by-side relation, and for holding them in their proper positions they are secured in the channel, for example, by means of embedding cementing compounds. The channels, or alternatively bars, provided with the guide teeth are fastened to the sley. For assembling the guide teeth according to the last named embodiment centering mandrels are used onto which the guide teeth are fitted with their picking apertures and spaced from each other by distance inserts, for example, plates. To ensure accurate alignment of the exit slots of the picking apertures of the guide teeth centering mandrels are used, the profile of which coincides with the geometry of the profile of the picking aperture of the guide tooth; a guide is used, most often a distance plate, which is fitted into the exit slots of the guide teeth and then uniformly pushed home onto the circumference of the centering mandrel within the length of the section of the picking channel.

Disadvantages of the known embodiments of picking channels are due to their construction. A common feature of these picking channels is an exacting manufacture and assembly thereof. Even when assembly jigs are employed, it is difficult to comply with the required accuracy of axial alignment of the picking apertures of the guide teeth and accurate alignment of their exit slots; a lack of accurate alignment subsequently manifests itself by weaving faults. The weft thread under insertion and the pressure fluid then impinge against the protruding front surfaces of the guide teeth of the picking comb. In case the guide teeth become demaged, their removal is difficult. It is true enough that the developments endeavor to bring about an improvement, for example, by arranging the guide teeth into replaceable sections. However, most often the active and subsequently the monitoring guide teeth become soiled or damaged and although arranged in said replaceable sections, often together with the passive guide teeth, it is necessary to remove a whole section if their function becomes faulty. Such replacement and subsequent repair are difficult and, moreover, warp thread breakages often occur during these operations, which in turn result in a further extension of unproductive activities of the weaving process in addition to the obvious extra work involved.

SUMMARY OF THE INVENTION

The above-mentioned drawbacks and disadvantages are substantially overcome by an improved arrangement of the picking comb according to the invention. In accordance with the invention, at least one of the guide teeth has its picking portion detachable from its mounting portion disposed on a carrier means.

Another feature of the invention is that the detachable picking portion of the guide teeth is provided with a connecting element which is disposed in a hole in the mounting portion, in which it is located with a resilient element and secured by a securing element, the picking portion being arranged with a positioning means of the mounting portion of the guide tooth mounted on the carrier means.

Another feature resides in that the mounting portion of a guide tooth is provided with a conduit for supplying the pressure fluid and discharging via the connecting element into the picking portion of the guide tooth which is made as an active guide tooth.

Another feature is that the detachable portion of a guide tooth is designed as a detecting one. The detecting means may be of the type disclosed in U.S. Pat. No. 4,085,777.

An advantage of the invention resides in a new arrangement of the picking channel and a more accurate assembly thereof. To this end simple and reliable means have been used. In view of the fact that in the construction of the active and detecting guide teeth elements of substantially identical form are used, their interchangeability is enabled; this makes it possible to replace a detecting guide tooth by an active guide tooth in the picking comb, which is advantageous in the first place when the weaving width of the fabric has to be changed. The interchangeability of the monitoring guide teeth for the active guide teeth and vice versa has also been made possible in that some of the guide teeth are attachable in a detachable manner so that when they have to be repaired, cleaned or replaced for the purpose of a repair, their removal and the subsequent assembly are easy without the necessity of removing and replacing a whole section of the picking comb or even the whole picking comb.

The improved arrangement is a simple one, particularly for handling by the operator of the loom and, in addition, the necessary work is reduced. When removing the active or monitoring guide teeth from the picking comb, the warp threads are not injured and, at the same time, the unproductive time is better utilized and/or the weaving productivity improved.

The manufacture of the picking channel according to the invention is simplified, and it is not expensive in view of the interchangeability of some of the guide teeth whereby it is possible to encompass a typified manufacture of, for example, sections in a reduced number for assembling a picking channel.

The assembly of the guide teeth is more accurate and it makes it possible to improve both the axial alignment of the picking apertures and the accurate alignment of their exit slots. As a result, the picking operation becomes more perfect, the weft thread does not impinge against the front surfaces of the guide teeth and, furthermore, snarling of the weft threads during their exit from the picking apertures of the guide teeth does not occur. The pressure fluid is utilized more effectively and can be reduced in volume. The reduced pressure fluid consumption can possibly be rationally utilized even for increasing the utility output of the jet loom for an increased warp width. Due to the reduction of weaving faults both the quality and the productivity of the weaving process are improved.

BRIEF DESCRIPTION OF THE DRAWINGS

In the accompanying drawings there is shown an example of a preferred embodiment of the picking comb according to the invention.

Figure 1:
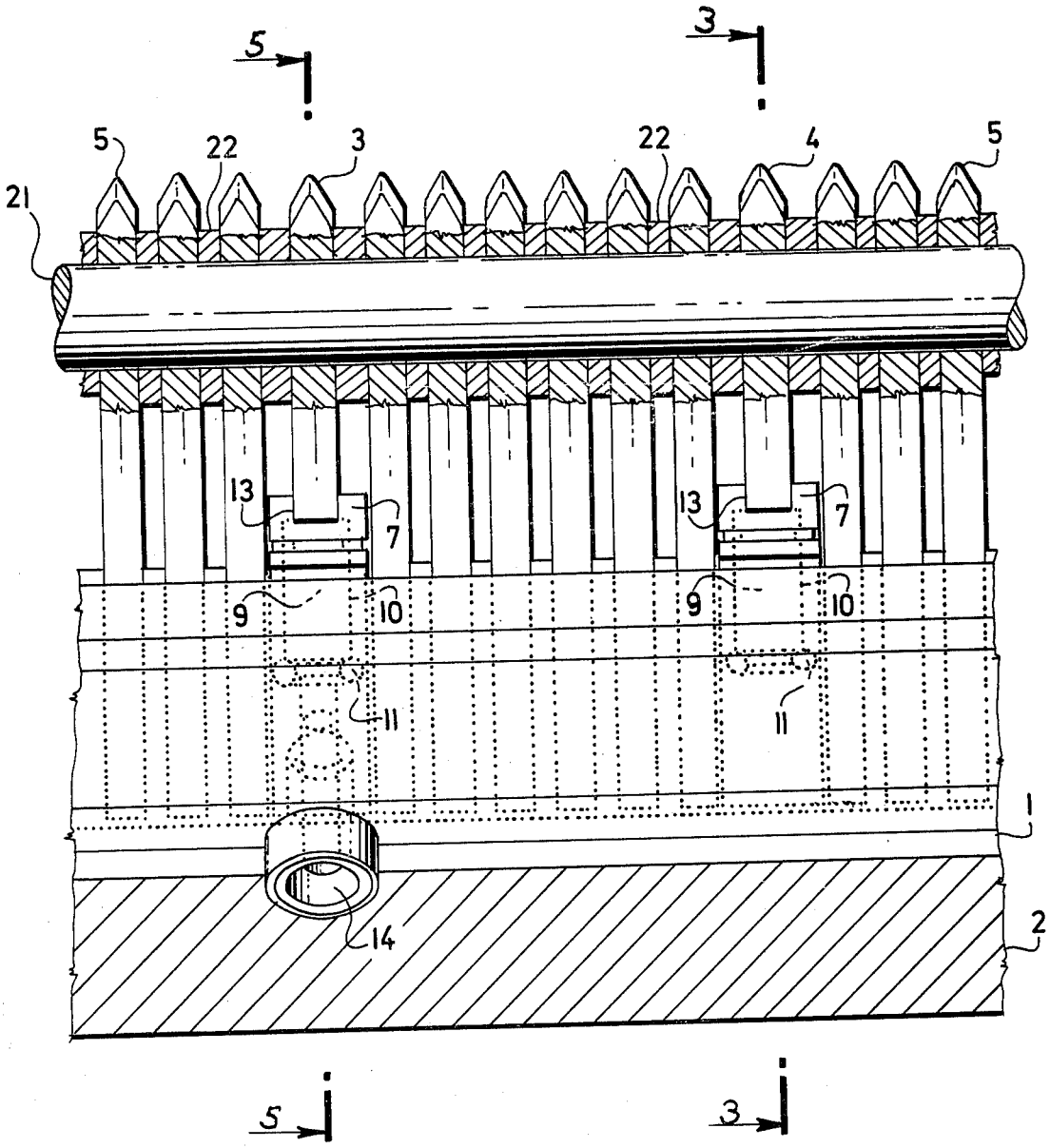
Figure 2:
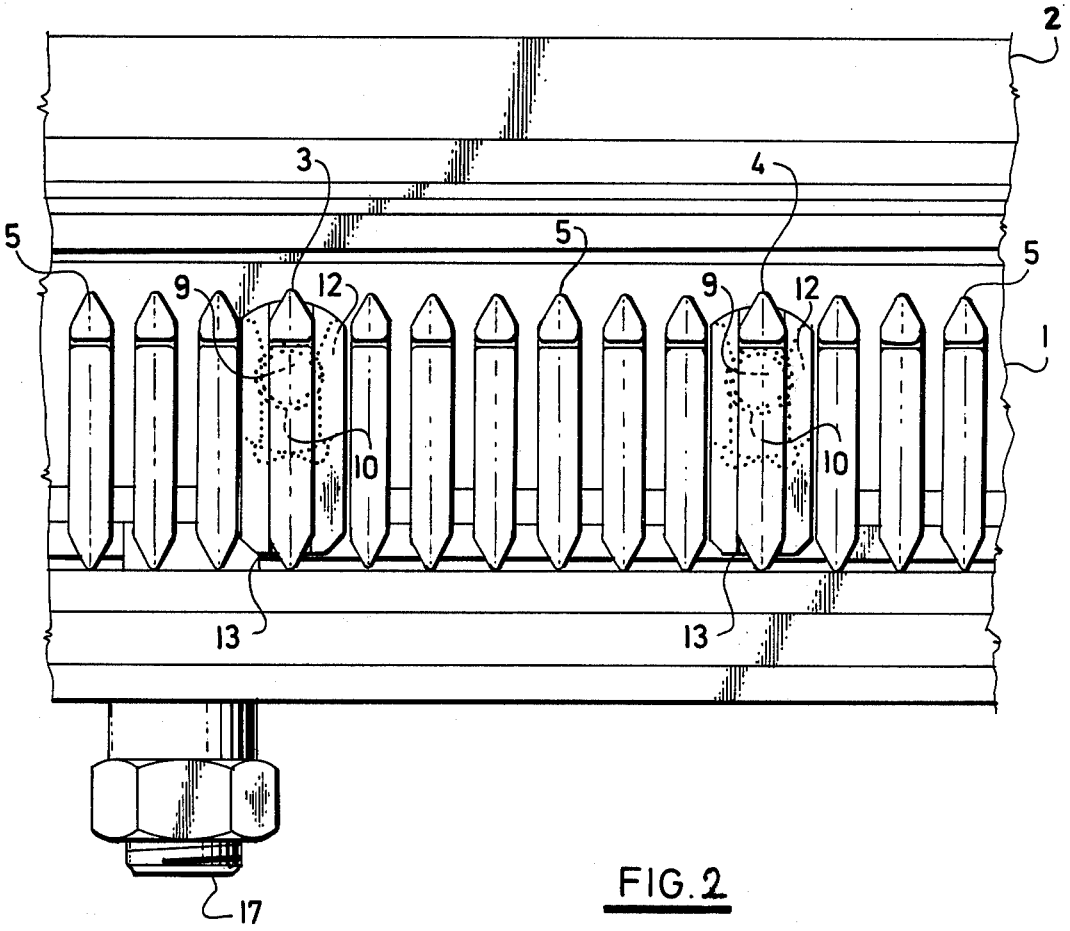
Figure 3:
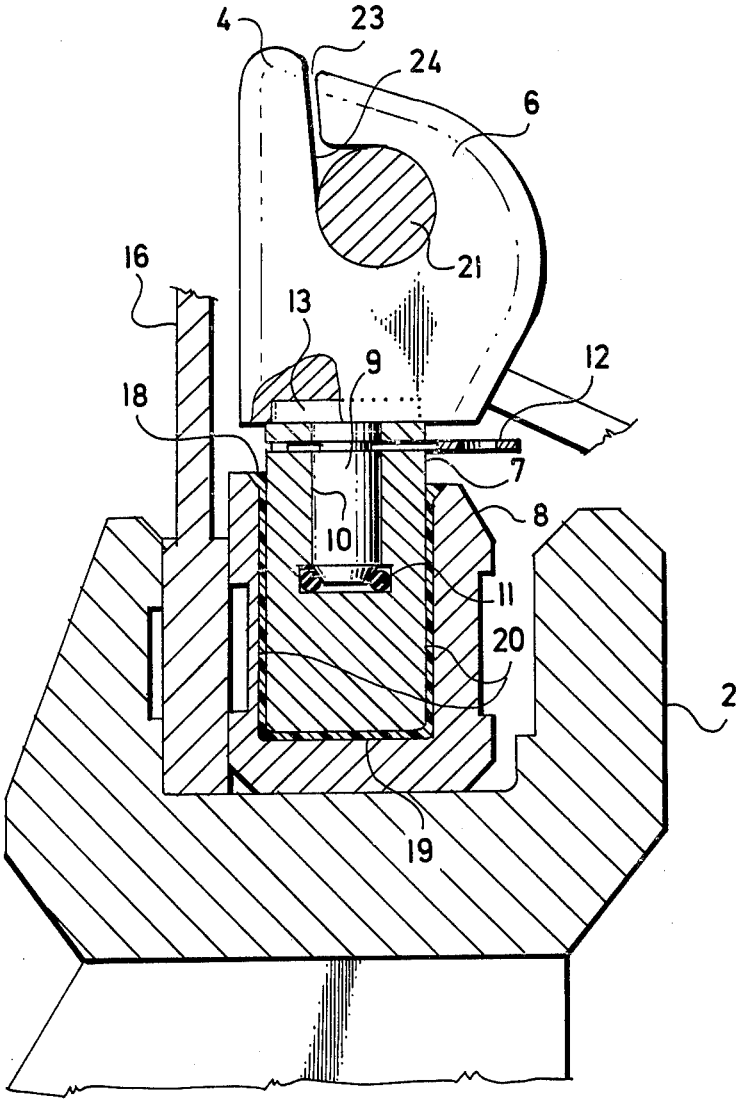
Figure 4:
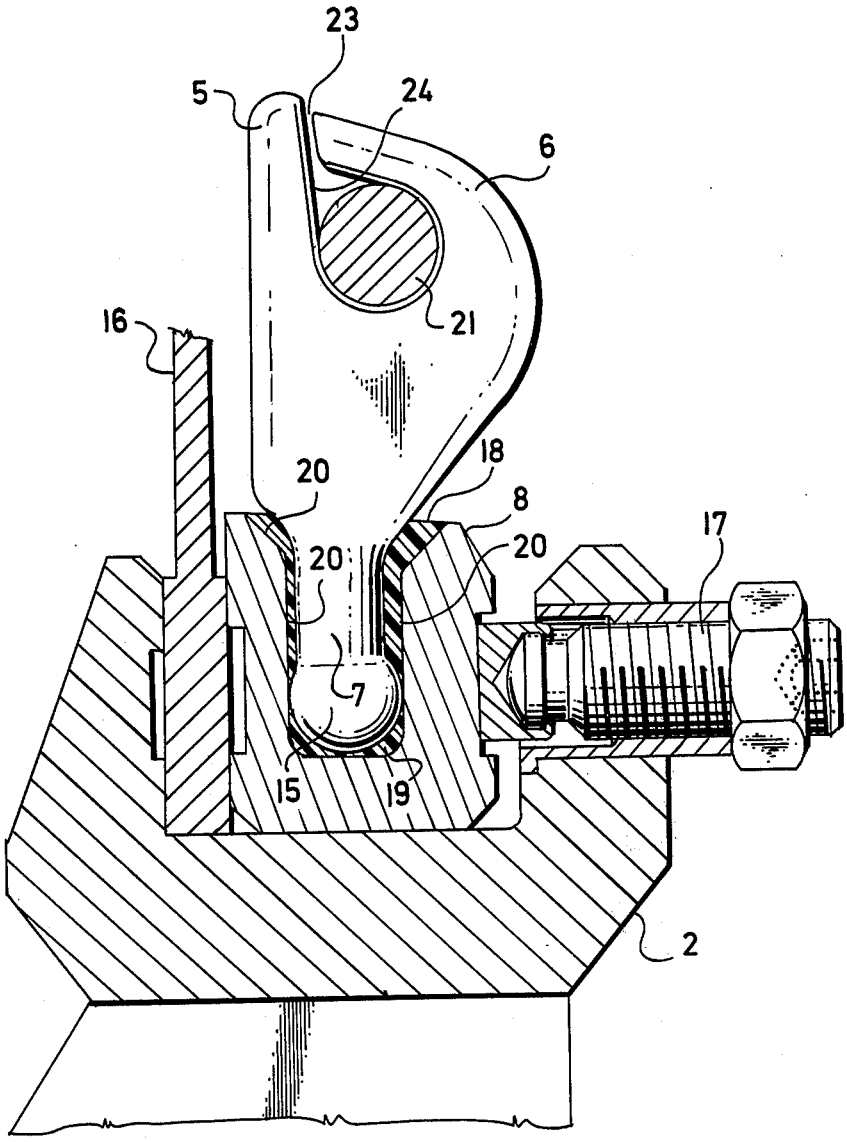
Figure 5:
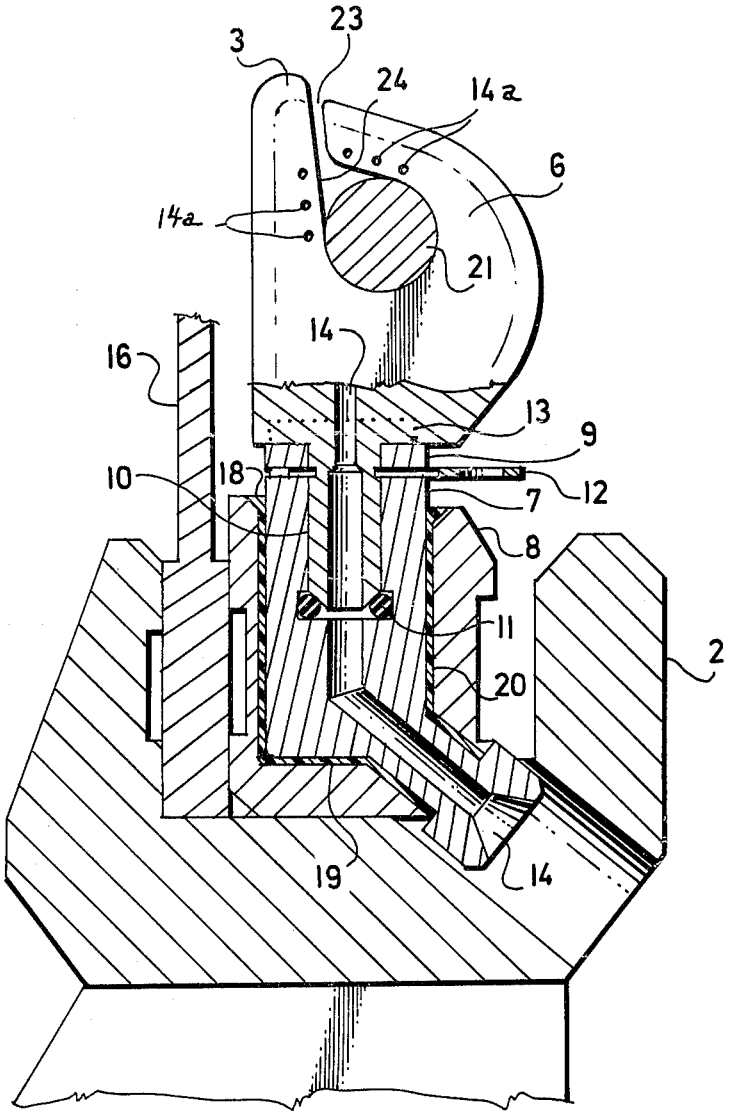

IN THE DRAWINGS:

FIG. 1 is a front view of a portion of a picking comb with some parts thereof being represented as if broken away; such figure further shows the assembly of guide teeth by using a centering mandrel and distance means prior to their fastening;

FIG. 2 is a plan view of a portion of the picking comb of FIG. 1;

FIG. 3 is a sectional side view of a portion of the picking comb made according to FIG. 1, the section being taken along a plane indicated by the line 3—3 of FIG. 1, some of the parts being shown in side view for better illustration, other parts being shown as if broken away;

FIG. 4 is a side view of a portion of the picking comb according to FIG. 1 with parts broken away;

FIG. 5 is a sectional side view of a portion of the picking comb made according to FIG. 1, the section being taken along a plane indicated by the line 5—5 of FIG. 1, some of the parts being shown in side view for better illustration.

DETAILED DESCRIPTION

Referring first to FIGS. 1 and 2, the picking comb as shown in the exemplary embodiment in the drawings is arranged of only passive guide teeth 5 complemented by an active guide tooth 3 and a detecting guide tooth 4, disposed in a spaced side-by-side relation. At least one of the teeth 3, 4, 5, has its detachable picking portion 6 connected to its mounting portion 7 which, together with undetachable mounting portions of the other guide teeth, for example passive guide teeth 5, is mounted on a carrier 8.

Mounting of the guide teeth (FIGS. 3, 4, and 5) onto the carrier means 8 is preferably carried out so that the mounting portions 7 are secured, for example, between inner surfaces 20 of a groove 19 provided in the carrier means 8 designed, for example, as a longitudinal bar, by an attaching means 18, preferably an embedding curable compound. The carrier means 8 provided with the guide teeth 3,4,5 is mounted and fastened, for example, together with a reed 16, by a connecting means 17 on a sley 2. It is preferable when the sley 2 is provided with a longitudinal groove in which the reed 16 and the carrier means 8 are located and clampingly connected by the connecting or clamping means 17, for example screws and nuts, disposed from the outer side of the sley 2 and at right angles to the bearing surfaces thereof.

THE DETECTING GUIDE TEETH

The detecting guide teeth 4 (FIG. 3) are preferably made in such a way that their picking portion 6 is provided with a connecting element 9, preferably a vertical round pin, which is provided with a transverse groove for arrangement with a securing element 12. The connecting element 9 is vertically mounted in a blind bore 10 of the mounting portion 7 which substantially has the form of a block. The connecting element 9, viz. round pin, abuts with its free end in the region of its face against a resilient element 11 disposed on the bottom of the blind bore 10. Position of the monitoring guide tooth 4 is assured by a positioning means 13 of the mounting portion 7. Means 13 is composed of mating accurately interfitting male and female formations which are preferably of non-circular section. The positioning means 13 in the mounting portion 7 can advantageously be made as a groove having a square section and extending at right angles to the longitudinal arrangement of the picking comb 1, into which the monitoring guide tooth 4 is fitted by the thickness of its picking portion 6. In vertical direction is the connecting element 9 of the detecting guide tooth 4 mounted in the hole 10 of the mounting portion 7 on the resilient element 11, preferably a rubber ring, and the position of the detecting guide tooth 4 is secured against displacement by the securing element 12, preferably a stirrup safety member, the inner portion of which is inserted into the groove of the pin, viz. connecting element 9, and on the outside into a groove formed in parallel in the mounting portion 7 of the detecting guide tooth 4. The mounting portion 7 is mounted in a groove 19 in the carrier means 8.

THE PASSIVE GUIDE TEETH

The passive guide teeth 5 (FIG. 4) may be made in the same configuration as the detecting guide teeth 4. However, they are easier to manufacture when the design of their mounting portion 7 is modified into the form of a stem 15 adapted to contact at least one of the inner surfaces 20 of the groove 19 provided in the carrier means 8 along the length thereof. These stems 15 are undetachably connected to the picking portions 6 of the passive guide teeth 5. The stems 15 or the mounting portions 7 thereof are secured on the carrier means 8 by the attaching means 18, shown here as an embedding curable compound.

THE ACTIVE GUIDE TEETH

The active guide tooth 3 (FIG. 5) is made substantially in the same form as the detecting guide tooth 4 except for the distinction that particularly its mounting portion 7 is provided with a conduit 14 for the supply of the pressure fluid. The conduit 14 extends through the sley 2 and the carriers means 8 into the mounting portion 7 and further discharges via the connecting element 9 into the picking portion 6 of the active guide tooth 3 which has ducts therein, and finally through jet forming openings 14*a* disposed on opposite sides of the exit slot 23 in the picking portion.

For the interchangeability of the detecting, active and possibly passive guide teeth 4, 3 and 5, respectively, it is of advantage when the embodiment of their mounting portions 7 substantially corresponds to that of the active guide tooth 3. For example, the picking comb assembled of only passive guide teeth 5 is made up of the mounting portions 7 of the active or possibly monitoring guide teeth 3 and 4, respectively, provided with passive guide teeth 5 made according to the detecting guide teeth 4, and of other passive guide teeth 5 made in a modified simpler embodiment wherein their mounting portions 7 are formed in the form of the stem 15 (FIG. 4) which is undetachable from the picking portions 6 of the passive guide of the passive guide teeth 5.

The picking comb according to the invention can advantageously be assembled in such a way that the guide teeth or an array made up of at least some of the active, detecting or passive guide teeth 3, 4 and 5, respectively, are fitted with picking apertures 24 of their picking portions 6 onto a centering mandrel 21 (FIGS. 1, 3, 4, and 5) preferably having a round section and the selected guide teeth are then spaced from each other by distance or spacer means 22, for example plates, rings or possibly the mounting portions 7. The mounting portions 7 of the selected active, detecting or passive guide teeth 3, 4 and 5, respectively, or the stems 15 or possibly the mounting portions having substantially the form of blocks, arranged with the detachable picking portions 6 are mounted onto the carrier means 8 between the inner surfaces 20 of the groove 19 in the carrier means. The exit slots 23 of the picking apertures 24 of the guide teeth may be aligned into a uniform section, whereafter the mounting portions 7 are mutually bonded to the carrier means 8 by the attaching means 18, as for example, an embedding curable compound. The carrier means 8 provided with the guide teeth 3, 4, 5 in accordance with said method is then secured together with the reed 16 to the sley 2 with the aid of the connecting means 17, and the centering mandrel 21 is then removed from the picking apertures 24 of the guide teeth 3, 4, 5.

In view of its advantages the picking comb according to the invention is applicable to pneumatic looms and, in an analogous manner, to looms wherein the weft thread is picked by means of a liquid.

Although the invention is illustrated and described with reference to a plurality of preferred embodiments thereof, it is to be expressly understood that it is in no way limited to the disclosure of such preferred embodiments but is capable of numerous modifications within the scope of the appended claims.

What we claim is:

1. A picking comb particularly for jet looms, comprising a carrier means adapted to be attached to a sley, guide teeth secured with their mounting portions, the mounting portion being mounted on the carrier means, at least one of the guide teeth having its picking portion detachable from its mounting portion.

2. A picking comb as claimed in claim 1, wherein the detachable picking portion of the said one guide tooth is provided with a connecting element which is arranged in a bore in the mounting portion and is disposed in said bore with a resilient element, and secured therein by means of a securing element, the picking portion of the said guide tooth being at the same time arranged with a positioning element of the mounting portion of the guide tooth mounted on the carrier means.

3. A picking comb as claimed in claim 2, wherein the said guide tooth is an active tooth, and the mounting portion of the said guide tooth is provided with a conduit for the supply of a pressure fluid, said conduit discharging via the connecting element into the picking portion of the said guide tooth.

4. A picking comb as claimed in claim 3, wherein the detachable portion of the said guide tooth is adapted as a detecting tooth.

* * * * *